US006151855A

United States Patent [19]

Campbell

[11] Patent Number: 6,151,855

[45] Date of Patent: Nov. 28, 2000

[54] ROOFING PANEL WITH ELASTOMERIC COATING AND METHOD

[75] Inventor: Larry D. Campbell, 1098 Wheatley Dr., Lilburn, Ga. 30047

[73] Assignee: Larry D. Campbell, Hiawassee, Ga.

[21] Appl. No.: 09/132,971

[22] Filed: Aug. 12, 1998

[51] Int. Cl.[7] ..... E04B 5/00

[52] U.S. Cl. ..... 52/408; 52/309.17; 52/481.1; 52/309.1; 52/783.1

[58] Field of Search ..... 52/747.12, 408, 52/469, 156, 410, 459; 442/175

[56] References Cited

U.S. PATENT DOCUMENTS

| | | | |
|---|---|---|---|
| 4,047,357 | 9/1977 | Mulholland et al. | 52/90 |
| 4,783,942 | 11/1988 | Nunley et al. | 52/309.1 |
| 4,996,812 | 3/1991 | Venable | 52/408 |
| 5,251,415 | 10/1993 | Van Auken et al. | 52/407 |
| 5,251,416 | 10/1993 | White | 52/410 |
| 5,644,880 | 7/1997 | Lehnert et al. | 52/408 |
| 5,925,579 | 10/1999 | Neuner et al. | 442/175 |
| 6,001,496 | 12/1999 | O'Haver-Smith | 428/703 |

*Primary Examiner*—Carl D. Friedman
*Assistant Examiner*—Patrick J. Chavez
*Attorney, Agent, or Firm*—Thomas, Kayden, Horstemeyer & Risley, L.L.P.

[57] ABSTRACT

A roofing panel with elastomeric coating incorporates a substantially rigid core with opposed first and second faces. In a preferred embodiment, the core is formed at least partially of portland cement and has a fibrous glass material attached to its first face and a woven polyester material attached to its second face. An elastomeric coating is also provided which is attached to the woven polyester material opposite the core, thereby forming a liquid impermeable layer at an exterior face of the panel. A method for incorporating the roofing panel of the present invention into a roofing system is also provided.

16 Claims, 1 Drawing Sheet

ROOFING PANEL WITH ELASTOMERIC COATING AND METHOD

FIELD OF THE INVENTION

The present invention generally relates to roofing systems. More particularly, the present invention relates to a roofing panel which incorporates an elastomeric coating and which is readily adapted for convenient job site installation. A method for utilizing the roofing panel of the present invention is also presented.

BACKGROUND OF THE INVENTION

Roofing systems are typically incorporated into a structure in order to promote weather-tight integrity, and in particular, watertight integrity of the structure. So provided, a roofing system should allow a structure to shed water which is then typically guided to ground level and away from the base of the structure. Over the years, the roofing industry has adopted numerous roofing systems for use with various types of structures in an effort to provide lasting weather-tight integrity of the structure at an affordable cost.

Conventional roofing systems used with high-pitched roofs typically incorporate shingles which are formed of a variety of materials, including asphalt laden felt or fiberglass, cedar, or slate, among others. The shingles are commonly arranged in multiple rows or courses, with the shingles of each course being aligned in an end-to-end relationship and then mechanically fastened to a roof support structure. Successive courses are then arranged to partially overlay each previous course so that water will run down successive courses of shingles and off the roof without having the opportunity to flow underneath underlying courses of shingles and onto the underlying roof support structure. This roofing system becomes problematic, however, as the pitch of a roof is decreased. This is because water sheds more slowly from a low-pitched roof than from a high-pitched roof, therefore, providing a greater opportunity for any water contacting the exterior surfaces of the shingles to seep under the shingles and potentially damage the underlying roof support structure.

Due to the aforementioned problems, flat and other low-pitched roofs, such as those used in commercial buildings, have typically incorporated roofing systems with water impermeable membranes formed of alternating layers of bituminous compound and felt sheet material. The bituminous compound typically arrives at the job site in solid form and is then liquefied by commercial heaters. The liquid bituminous compound is then laboriously transported to the roof of the building and spread across the roof support structure, such as by mopping the liquid bituminous compound manually, until a substantially uniform layer is formed. The felt sheet material is then transported to the roof and laid upon the liquid bituminous layer, thereby bonding the felt to the roof support structure. This process is repeated several times until a liquid impermeable felt-bituminous membrane is formed. A layer of gravel is then typically formed above the membrane as a protective covering against wind and ultra-violet rays which both can damage the membrane.

In order to alleviate the labor intensive process of forming a felt-bituminous membrane upon a roof support structure, several roofing systems have been recently developed which incorporate liquid impermeable sheet materials which do not require the use of large quantities of liquefied bituminous compound or multiple layers of sheet material to form a watertight roof For example, U.S. Pat. Nos. 3,971,184 and 4,021,981 disclose insulated, water impermeable roofing systems, each of which incorporates factory assembled roofing panels.

As disclosed in the aforementioned patents, each roofing panel includes a self-adherent, water and vapor impermeable membrane upon which an insulation layer and an optional protective layer are constructed. The panels are adhered in a spaced-relationship about a roof support structure by removing a release paper from the impermeable membrane and then by pressing each panel against the support structure. Spaces between adjacent panels are then filled with a self-adherent plastic filler compound which bonds to the impermeable membranes of adjacent panels to form a continuous water and vapor impermeable layer which is formed at the bottom of the panels between the insulation layer and the roof support structure. Although these roofing systems have each met with a degree of commercial success, several problems limit their effectiveness, including: increased labor costs associated with preparing the roof support structure in order to promote adhesion of the liquid impermeable membrane to the support structure; the requirement for special equipment at the job site in order to apply the filler compound, and; the expense of the filler compound itself.

Additionally, U.S. Pat. No. 4,783,942 discloses a roofing system incorporating fiberglass faced mineral boards which are mechanically fastened to a roof support structure of corrugated material. A layer of adhesive is applied to the upper faces of the mineral boards and then rolls of waterproof sheet material, such as ethylene propylene diene terpolymer (EPDM), are arranged on and bonded to the adhesive layer. Although this roofing system has also met with a degree of commercial success, several problems limit its effectiveness, including the labor intensive job site application of the EPDM to the mineral boards, and the added time and care which must be used by the installers to ensure that the entire roof support structure is properly covered by overlapping sheets of the EPDM.

Therefore, it would be desirable to provide a roofing system which incorporates a series of individual roofing panels each of which incorporates a liquid impermeable membrane and each of which can be installed by unskilled laborers in a relatively short period of time to form a watertight roofing system upon a variety of roof support structures.

SUMMARY OF THE INVENTION

Briefly described, a roofing panel of the present invention comprises a core formed of gypsum, portland cement, plywood or various other materials. The core is covered on one face with a woven material, such as woven polyester, among others, and is optionally covered on its other face with one or more of a variety of materials, such as fibrous glass, paper, woven polyester, etc. Each of the facing materials is attached to the core in a known conventional manner, such as by an adhesive. A layer of waterproof material, such as an elastomeric material, is then bonded to the exterior surface of the woven material to form a liquid impermeable membrane on that face of the panel.

The layer of waterproof material can take various forms, such as a sheet material which is then bonded to the woven material, e.g. with an adhesive. A liquid material, such as a flexible acrylic waterproofing system, i.e. Finish Coat produced by Sealoflex, also can be used. The liquid material is preferably applied to the woven material so that a portion of the liquid seeps between the individual fibers of the woven material prior to drying, thereby strengthening the bond between the woven material and the waterproof layer after the liquid dries. In this manner, pre-formed roofing panels which incorporate a liquid impermeable membrane may be transported to a job site and installed by unskilled labor as described herein below.

According to another aspect of the present invention, a method of forming a roof structure with the aforementioned roofing panels is presented which is readily adaptable for use upon a variety of roofs, and which is particularly well suited for use as a retrofit roofing system to be applied over an existing roofing system. The method includes fastening multiple roofing panels in a perimeter edge-abutting relationship to a roof support structure with the waterproof membrane facing away from the roof support structure. The abutting portions or joints formed between adjacent panels are then sealed by covering the joint with a strip preferably formed of woven material and then applying a liquid waterproofing material, such as a liquid elastomeric material, to the exterior of the strip. After the liquid waterproofing material dries, a liquid impermeable membrane is formed on the exterior surface of the entire roofing system.

Other objects, features and advantages of the present invention will become apparent upon reading the following specification, when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. The components in the drawings are not necessarily to scale, emphasis instead being placed upon clearly illustrating the principles of the present invention.

DETAILED DESCRIPTION OF THE PREFERRED EMBODIMENTS

Figure 1:
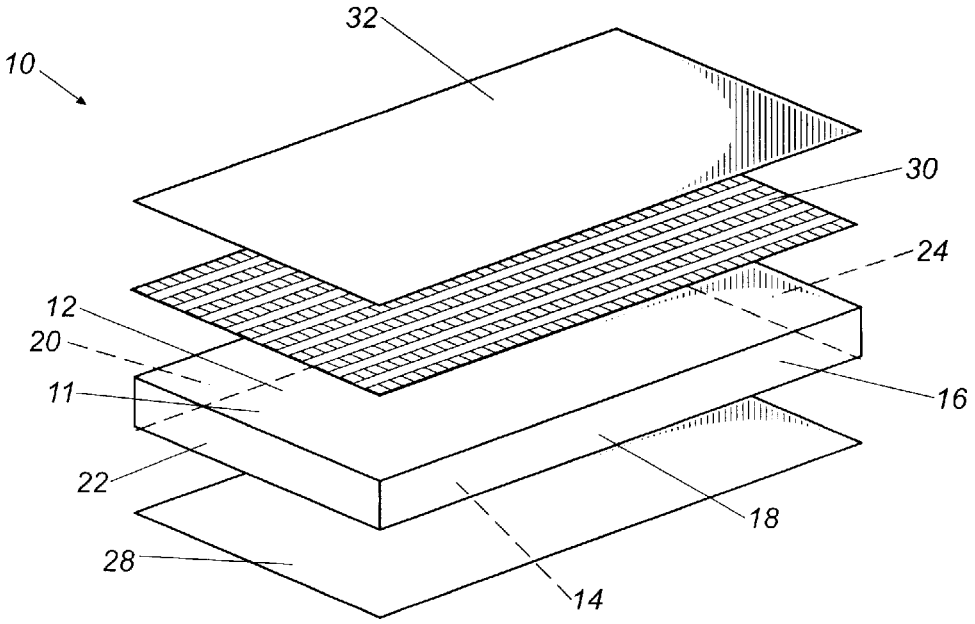
FIG. 1 is a partially exploded, perspective view of a preferred embodiment of the roofing panel of the present invention.

Referring now to the figures, wherein like reference numerals design ate like parts throughout the several views, FIG. 1 depicts a preferred embodiment of a roofing pane 10 of the present invention. As shown in FIG. 1, panel 10 is constructed with a core 11 which is preferably formed of cementaceous material, such as portland cement, but which also can be formed of various other materials such as gyp sum compounds, plywood, particle board and other materials and combinations of materials, which are capable of providing a substantially rigid core. Although cementaceous material is disadvantageously heavier than gypsum compounds, gypsum degrades when exposed to moisture; therefore, a particular core material may be better suited than others depending on the particular application.

Although some suitable core materials (i.e. thinly formed gypsum) may not be substantially rigid unless incorporating a minimum thickness or a facing material (i.e. paper, fibrous glass, etc.) covering at least one face of the core material as described hereinbelow, the resultant combination of (1) a less than substantially rigid core material, and (2) at least one face of the core material being covered by a facing material to form a substantially rigid core structure, is considered adequate to practice the teachings of the present invention.

Additionally, panel 10 can be formed in various configurations and in various dimensions, however, it should be noted that preferred embodiments of the panel 10 incorporate a rectangular shape and standard building material height and width dimensions, such as 4'×8', 4'×12', etc., as well as standard thickness dimensions, such as ¼", ⅜", ½", etc.

As shown in FIG. 1, core 11 has opposing faces 12 and 14, and a perimeter edge 16 formed of opposed sides 18 and 20 and opposed ends 22 and 24. Face 14 is covered with a first facing material 28 which is preferably in the form of a fibrous glass layer, but which also can be formed of a woven material, such as woven polyester. It has also been found that paper, paperboard, wood, plastic, resin, or other various materials can be used to provide rigidity to the core 11 depending on the core material used. Additionally, some embodiments do not require the use of a first facing material 28 in order to provide rigidity to the core, as described hereinabove. Some embodiments, however, also can incorporate a first facing material 28 in order to protect the core from damage which can be imparted to a panel 10 during transportation, installation, etc.

As shown in FIG. 1, face 12 is covered with a second facing material 30 which is preferably in the form of a woven material, such as woven polyester, or other woven materials formed of water-resistant fibers. Fibrous glass material, or other various materials which are sufficiently resistant to tearing also can be used in order to provide strength to a layer of waterproof material 32 which is then bonded to the second facing material 30.

Each of the facing materials, 28 and 30 respectively, are attached to the core 11 in a known conventional manner, such as by an adhesive (not shown), by impressing the facing materials onto the core prior to curing the core, etc. Additionally, the facing materials can extend beyond the periphery of its respective face in some embodiments, thereby at least partially extending around the edges of the panel.

The layer of waterproof material 32 is preferably bonded to the facing material 30 by applying the waterproof material 32 in liquid form to the exposed surface of the facing material 30 (opposite the core). When so applied, the liquid waterproof material, such as a liquid elastomeric material, i.e. Rubberflex produced by Republic Powdered Metals, Inc., among others, is able to seep into the facing material 30, i.e. between the fibers of the woven material prior to drying into a continuous layer or coating. Additionally, some embodiments are configured so that the liquid waterproof material seeps between the fibers of the woven material and at least partially engages the core prior to drying. So configured, bonds formed between the facing material 30, the layer of waterproof material 32 and the core 11, and the ability of the waterproof material to resist tearing are strengthened.

In other embodiments, the layer of waterproof material 32 can be configured as a liquid impermeable sheet material, i.e. EPDM, among others, which is then bonded to facing material 30, such as with an adhesive (not shown).

Thus presented, pre-formed roofing panels 10 of various sizes and shapes can be formed which incorporate a liquid impermeable membrane when they arrive at a job site, thereby offering considerable savings in time and labor during installation when compared to the prior art.

A roofing system 33 incorporating the aforementioned roofing panels is also presented which is readily adaptable to a variety of roof support structures, and which is particularly well suited for use as a retrofit roofing system to be applied over an existing roofing system. Although a preferred method of utilizing the panels of the present invention is discussed in relation to applying the roofing system 33 over an existing conventional bituminous-felt roofing system, it should be understood that the system 33 is equally well suited to a variety of roofing applications.

Figure 2:
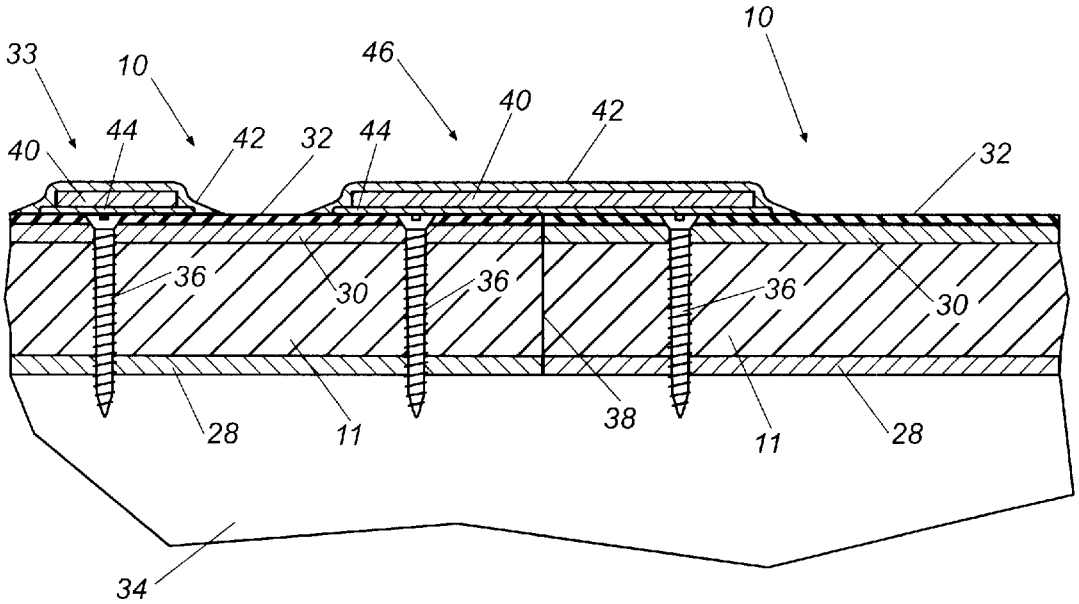
FIG. 2 is a partially cut-away, cross sectional view of two roofing panels formed in accordance with a preferred embodiment of the present invention with the panels arranged in accordance with a preferred method of application of the present invention.

A preferred method of applying the roofing system 33 over an existing conventional bituminous-felt roofing system includes removing any protective layer of gravel (not shown) from the roof of a structure. This has the advantage of decreasing the weight of the roofing system and typically exposes a relatively uniform roof support structure 34 (FIG. 2). Particular care need not be taken to remove all gravel dust or to otherwise clean the exposed exterior surface of the support structure 34 with chemical solvents or other cleaners as would be required when employing numerous prior art roofing systems.

Multiple panels 10 are then transported to the roof and fastened to the roof support structure 34 in a perimeter edge-abutting relationship with each other with the waterproof material 32 facing away from the roof support structure 34 (FIG. 2). Fastening of the panels 10 can be accomplished in a variety of methods that are well known to those of ordinary skill in the art, including, but not limited to: using mechanical fasteners 36 such as screws, nails, bolts, clips, etc; applying an adhesive (not shown), such as "liquid nails," liquefied bituminous compound, etc, between the panels 10 and the support structure 34, or; a combination of both mechanical fasteners and adhesive.

As shown in FIG. 2, the abutting portions or joints 38 formed between adjacent panels 10 are then sealed by covering the joint 38 with a strip 40 preferably formed of woven material, such as woven polyester. A top layer 42 of liquid waterproofing material, i.e. a liquid elastomeric material, is then applied to the exterior of the strip 40, such as with a conventional paint roller or other suitable applicator. A bonding layer 44 of liquid waterproofing material also can be disposed between the strip 40 and the joint 38 in order to promote adhesion of the strip to the panels 10 as well as to enhance the water-tight integrity and overall strength of the joints. After the layers of liquid waterproofing material dry, a liquid impermeable membrane 46 is formed on the exterior surface of the roofing system.

Additionally, as shown in FIG. 2, exposed portions of fasteners 36 which penetrate the panels 10 are treated in similar fashion to that of a joint 38, as described hereinabove, in order to form the membrane 46.

The foregoing description has been presented for purposes of illustration and description. It is not intended to be exhaustive or to limit the invention to the precise forms disclosed. Obvious modifications or variations are possible in light of the above teachings. The embodiment or embodiments discussed, however, were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

I claim:

1. A roofing panel comprising:

a substantially rigid core having opposed first and second faces, said core being formed of portland cement;

a first facing material formed of fibrous glass attached to and substantially co-extensively juxtaposed the first face of said core;

a second facing material formed of woven polyester material attached to and substantially co-extensively juxtaposed the second face of said core, said woven polyester material having a plurality of adjacent fibers;

an adhesive disposed between said second facing material and said core; and a liquid impermeable layer formed of elastomeric material attached to and substantially co-extensively juxtaposed said second facing material opposite said core, at least a portion of said liquid impermeable layer at least partially formed between adjacent fibers of said second facing material when said elastomeric material is in a liquid form and drying therebetween to form a bond between said liquid impermeable layer and the fibers of said second facing material.

2. A roofing panel comprising:

a core having opposed first and second faces and a perimeter edge, said perimeter edge having opposed side edges and opposed ends, said core being formed of cement;

a first facing material attached to the first face of said core;

a second facing material formed of woven polyester attached to the second face of said core; and a liquid impermeable layer attached to said second facing material opposite said core, said liquid impermeable layer being formed of an elastomeric, acrylic waterproofing material and being attached to said second facing material when said elastomeric material is in a liquid form such that at least a portion of said elastomeric material extends through said second facing material and engages said core, thereby forming a waterproof barrier adjacent said second facing material such that water is prevented from penetrating said second face of said core via said second facing material.

3. The roofing panel of claim 2, wherein said first facing material is formed of a woven polyester material.

4. A roofing system for use on a roof support structure, said roofing system comprising:

a plurality of roofing panels, each panel having a core, said core having opposed first and second faces and a perimeter edge, a first facing material attached to and at least substantially co-extensively juxtaposed the first face of said core, a second facing material attached to and at least substantially co-extensively juxtaposed the second face of said core, and a liquid impermeable layer formed of an elastomeric, acrylic waterproofing material attached to and at least substantially co-extensively juxtaposed said second facing material opposite said core, said liquid impermeable layer forming a waterproof barrier adjacent said second facing material such that water is prevented from penetrating said second face of said core via said second facing material, said perimeter edge having opposed side edges and opposed ends, each of said panels arranged in perimeter edge-abutting relationship with others of said panels such that said core of each of said panels is disposed between said second facing material and the roof support structure and a joint is formed between abutting edges of adjacent panels;

fasteners securing said panels in said perimeter edge-abutting relationship to the roof support structure;

a strip of woven material engaging said liquid impermeable layers of adjacent panels and overlying said joint disposed therebetween, and;

a top layer of elastomeric material overlying said strip of woven material and engaging said liquid impermeable layers of said adjacent panels only in areas adjacent said joints.

5. The roofing system of claim 4, wherein said core is formed at least partially of portland cement.

6. The roofing system of claim 4, wherein said second facing material is formed of a woven material.

7. The roofing system of claim 4, wherein said first and second facing materials are formed of woven material.

8. The roofing system of claim 4, wherein said second facing material is formed of a woven polyester material.

9. The roofing system of claim 8, wherein said fasteners are mechanical fasteners.

10. The roofing system of claim 8, wherein said fasteners are areas of adhesive material disposed between said first facing material and the roof support structure.

11. A method for forming a roofing system upon a roof support structure, said method comprising the steps of:

providing a plurality of roofing panels, each roofing panel comprising a substantially rigid core having opposed first and second faces, a perimeter edge, a second facing material attached to said second face, and a liquid impermeable layer formed of an elastomeric, acrylic waterproofing material formed adjacent said second face opposite said core, said liquid impermeable layer forming a waterproof barrier adjacent said second facing material such that water is prevented from penetrating said second face of said core via said second facing material;

arranging said roofing panels in perimeter edge-abutting relationship with each other about a roof support structure such that said core of each of said panels is disposed between said second facing material and the roof support structure and a joint is formed between abutting edges of adjacent ones of said panels;

fastening said panels to the roof support structure;

applying strips of woven material in overlying relationship with said joints such that each of said strips engage said liquid impermeable layers of adjacent ones of said panels, and;

applying a top layer of elastomeric material to each of said strips of woven material such that said top layer engages each of said strips and said liquid impermeable layers of said adjacent panels only in areas adjacent said joints.

12. The method of claim 11, wherein said second facing material is formed of a woven polyester material.

13. The method of claim 12, wherein each of said panels has a first facing material attached to said first face.

14. The method of claim 13, wherein said first facing materials are formed of woven polyester material.

15. The method of claim 11, wherein the step of fastening said panels includes fastening said panels to the roof support structure with mechanical fasteners.

16. The method of claim 12, wherein said strips of woven material are woven polyester material.

* * * * *